US005704834A

United States Patent [19]

Sells

[11] Patent Number: 5,704,834

[45] Date of Patent: Jan. 6, 1998

[54] MOISTURE RESISTANT ROOF VENT

[75] Inventor: Gary L. Sells, Mishawaka, Ind.

[73] Assignee: Cor-A-Vent Inc., Mishawaka, Ind.

[21] Appl. No.: 641,621

[22] Filed: May 2, 1996

[51] Int. Cl.[6] ..... F24F 7/02

[52] U.S. Cl. ..... 454/365; 52/199

[58] Field of Search ..... 454/365; 52/57, 52/199

[56] References Cited

U.S. PATENT DOCUMENTS 4,843,953 7/1989 Sells ..... 454/365

5,352,154 10/1994 Rotter et al. ..... 454/365

*Primary Examiner*—Harold Joyce

*Attorney, Agent, or Firm*—Baker & Daniels

[57] ABSTRACT

A ventilating cap for the ridge of a roof includes a pair of vent parts located on opposite sides of a vent opening cut along ridge board of the roof. A flashing holds an air permeable, moisture-repelling fabric against the outer edge of the vent parts, thereby preventing intrusion of snow and other moisture into the vent opening through the vent parts.

14 Claims, 5 Drawing Sheets

MOISTURE RESISTANT ROOF VENT

This inventions relates to a ventilating cap for the ridge of a roof. Ventilating roof caps are known in the prior art. One such ventilating cap is disclosed in U.S. Pat. No. 3,949,657, and includes a pair of elongated vent parts mounted on opposite sides of the ridge of the roof. The cap has an upper surface which interconnects the part and which bridges across a vent opening cut along the ridge of the roof. Each vent part includes in inner edge which extends adjacent the vent opening and an opposite outer edge. Each vent part is made out of a corrugated material such that a large number of passages are defined interconnecting the inner and outer edges of each of the vent parts, thereby venting air from the attic or upper story of a structure through the vent opening and the passages to ambient atmosphere. One problem associated with prior art vent caps is that, under certain very adverse weather conditions, wind driven snow or rain may be driven through the vent passages and into the attic or upper story of the structure, thus causing water damage to the structure. One way of solving the problem known in the prior art is disclosed in U.S. Pat. No. 4,843,953, in which a perforated flashing member is secured to the vent part. The flashing includes a side extending over the outer edge of the vent part thereby restricting entry of snow or moisture into the passages. One problem associated with this solution, however, is that if the perforations in the flashing are small enough to prevent entry of moisture into the passages, the vent area may be too restrictive.

According to the present invention, a flexible, air permeable, moisture repelling, woven or nonwoven fabric covers the outer side edges of the vent parts and extends over the vent passages to resist penetration of moisture into the vent passages. The fabric is held in place by a flashing which may be either attached directly to the roof (and be unattached to the vent parts), or is attached to the vent parts. Because the fabric repels moisture and is air permeable, restriction of the vent passages for venting is minimal, but the fabric is effective in repelling moisture begin driven into the vent opening through the passages.

These and other advantages of the present invention will become apparent from the following description, with reference to the accompanying drawings, in which.

Figure 1:
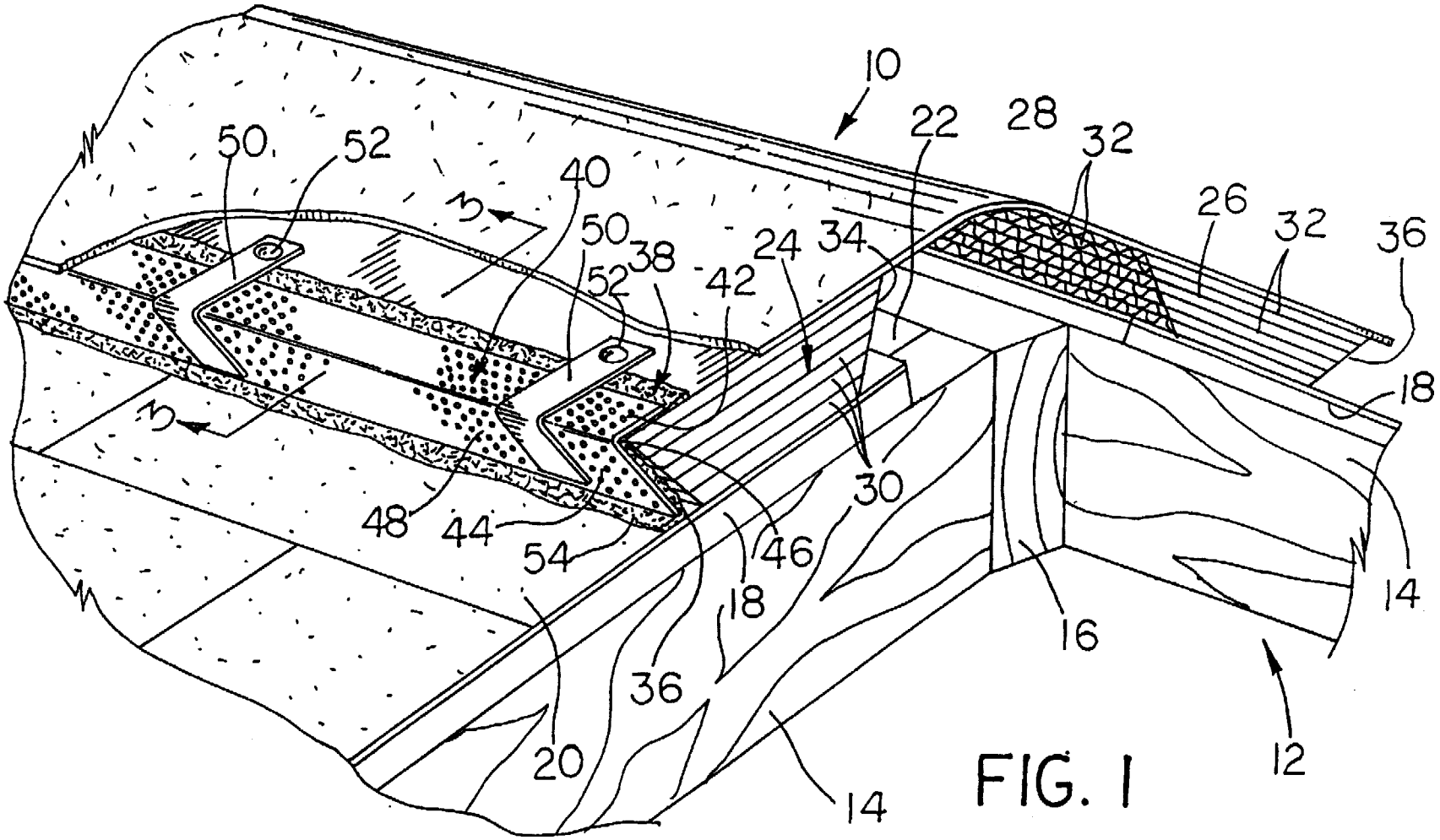
FIG. 1 is a fragmentary perspective view of a vent cap made pursuant to the teaching of the present invention shown mounted on a roof of a structure, with portions of the roof cut away to facilitate illustration.
Figures 3, 4:
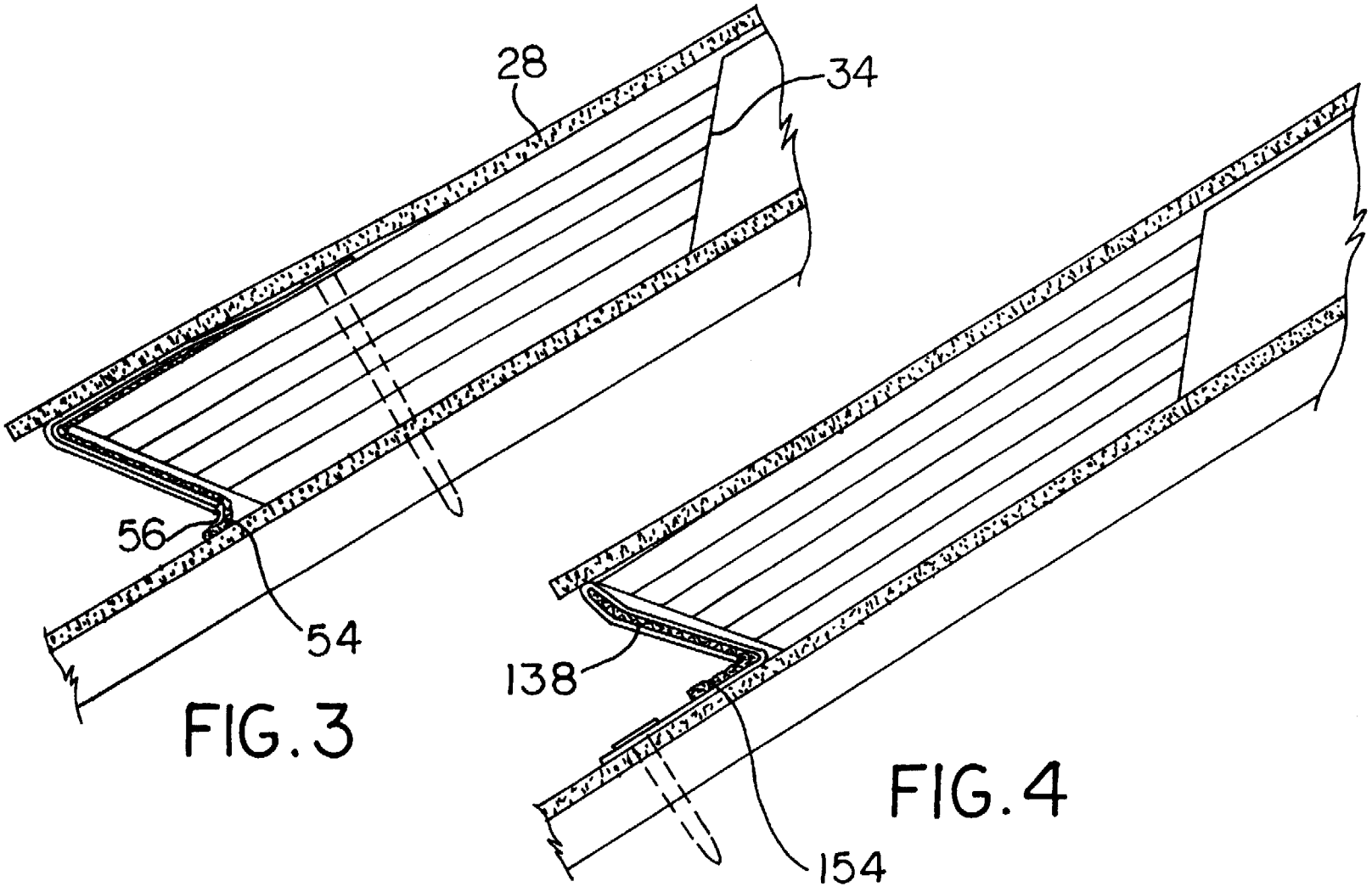
FIG. 3 is a cross-sectional view taken substantially along lines 3—3 of FIG. 1.
FIG. 4 is a view taken substantially along lines 4—4 of FIG. 2.

Referring now to FIGS. 1 and 3 of the drawings, a ventilating cap generally indicated by the numeral 10 is shown mounted on a roof generally indicated by the number 12. The remainder of the roof has been broken away are not shown for ease of illustration. The roof 12 consists of inclined rafters 14 and a ridge board 16 which interconnects the rafters. Sheathing 18 is mounted on the rafters 14 and is covered by shingles 20. A portion of the sheathing 18 on opposite sides of the ridge board 16 has been cut away to define a vent opening 22, for venting attic or upper floor of the structure covered by the roof 12.

Vent cap 10 includes a pair of longitudinally extending vent parts 24 and 26. Each of the vent parts 24,26 extend longitudinally along the roof 12 substantially parallel to the ridge board 16 and the vent openings 22 cut on opposite sides of the ridge board 16. Preferably, after the ventilating cap 10 is installed on the roof 12, the ventilating cap may be covered with shingles similar to the shingles 20. Each of the vent parts 24,26 consist of a number of layers or courses 30 of a corrugated material. The uppermost layer or cover defines a connecting member 28 which interconnects the vent parts 24,26 and extends over the ridge board 16 and vent opening 22. The corrugations define passages 32 which extend through the vent parts 24,26 substantially parallel with one another between the inner edges 34 of each vent part 24,26 to the outer edges 36 thereof. Accordingly, the passages 32 define a vent passage which vents the attic or upper story of the structure covered by the roof 12 through a vent path defined by the vent openings 22 and the passages 32. The passages vent the vent openings to ambient atmosphere. More details of the basic ventilating cap 10 are disclosed in the aforementioned U.S. Pat. No. 3,949,657.

According to the present invention, the outer edges 36 of at least one of the vent parts 24,26 is covered by a flexible, air permeable, moisture repelling fabric generally indicated by the numeral 38. The fabric 38 may be a nonwoven, spunbonded fabric consisting of randomly arranged polypropylene fibers that is sold as "Typar 3121" by Snow Filtration Company, Cincinnati, Ohio. The fabric is held adjacent the outer edge 36 of the vent part 24 by a perforated metal flashing generally indicated by the numeral 40. The flashing 40 includes a pair of side members 42,44 which are joined at an apex 46. The angle between the members 42 and 44 is chosen such that the side member 44 is substantially parallel to the side edge 36 when the side member 42 is mounted on the upper proportion of the vent part 24. Perforations 48 of the flashing member 40 allow air vented from the attic through vent opening 22 and the passages 32 to pass through the flashing member 40. Brackets 50 secured to the flashing member 40 and are held in place by nails 52 which extend through the vent part 24 and into the underlayment 18, as clearly shown in FIG. 3. Portion 54 of the fabric 38 curves under the lower edge 56 of the side member 44 and sweeps against the shingles 20 mounted on underlayment 18, thereby resisting entry of moisture into the vent part 24 around the end 56.

Figure 2:
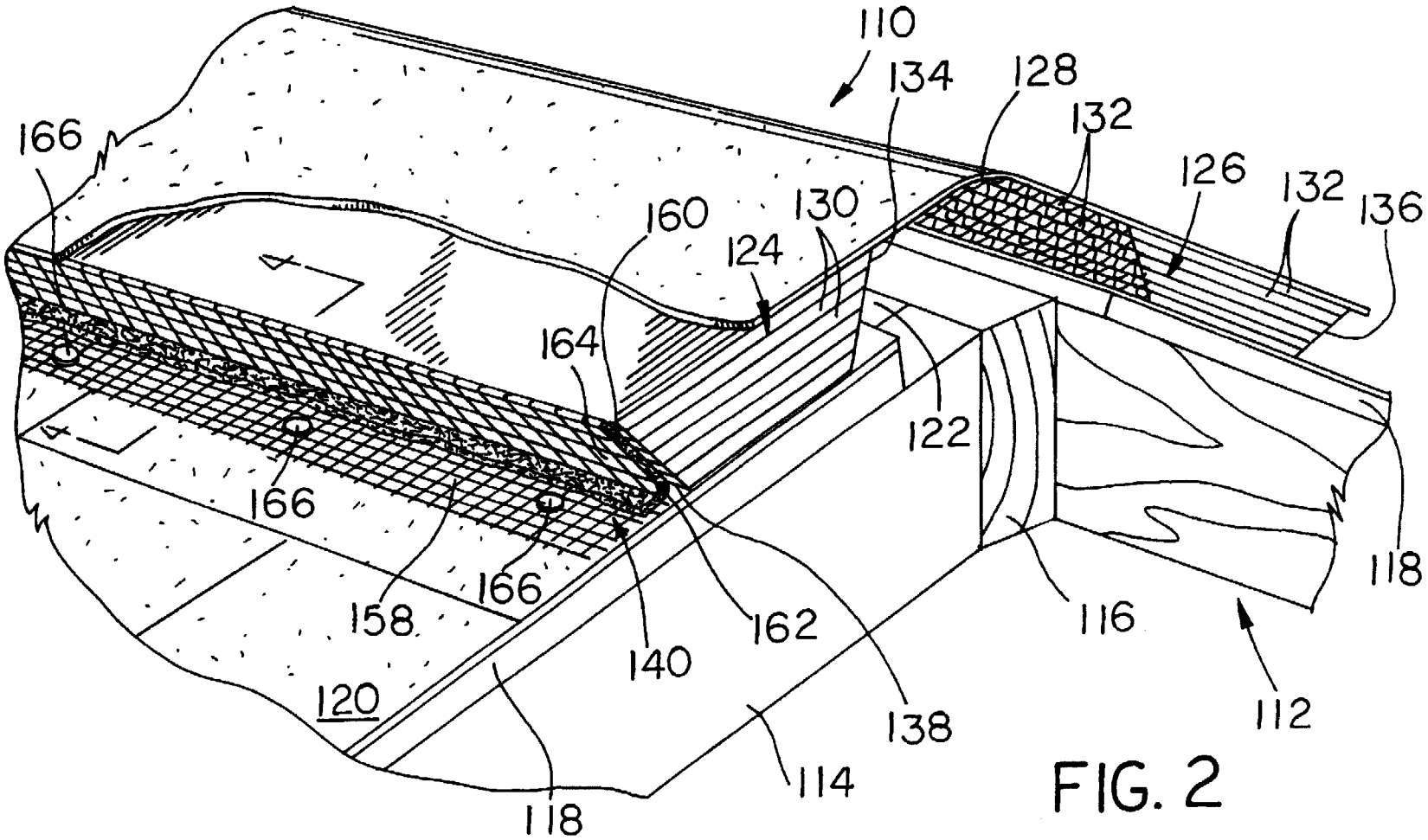
FIG. 2 is a view similar to FIG. 1, but illustrating another embodiment of the present invention.
Figure 6:
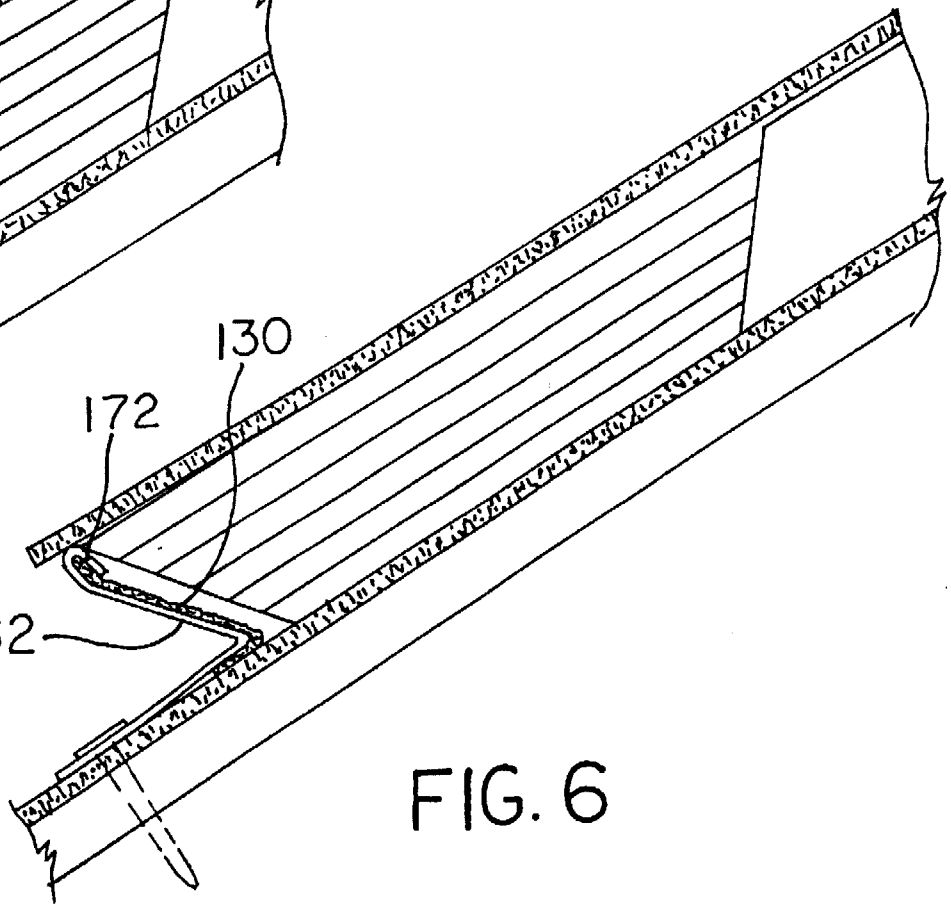
FIGS. 5, 6, 7 are views similar to FIG. 4 but illustrating alternate embodiments of the invention.
Figure 5:
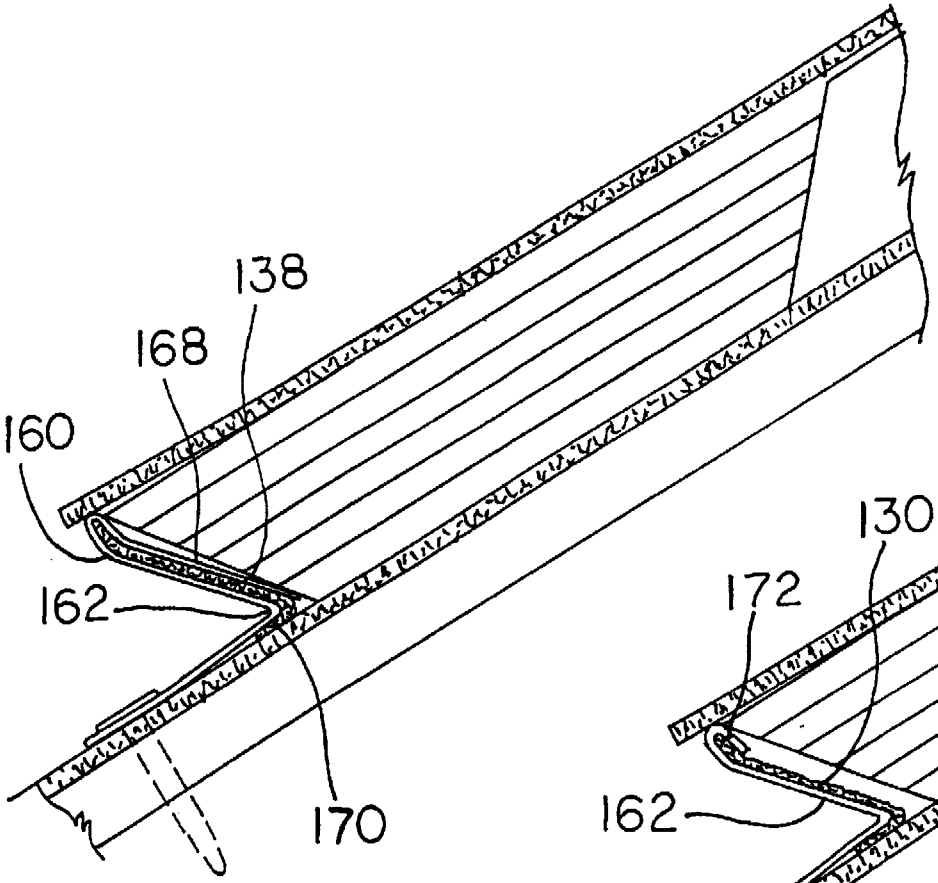
Figure 7:
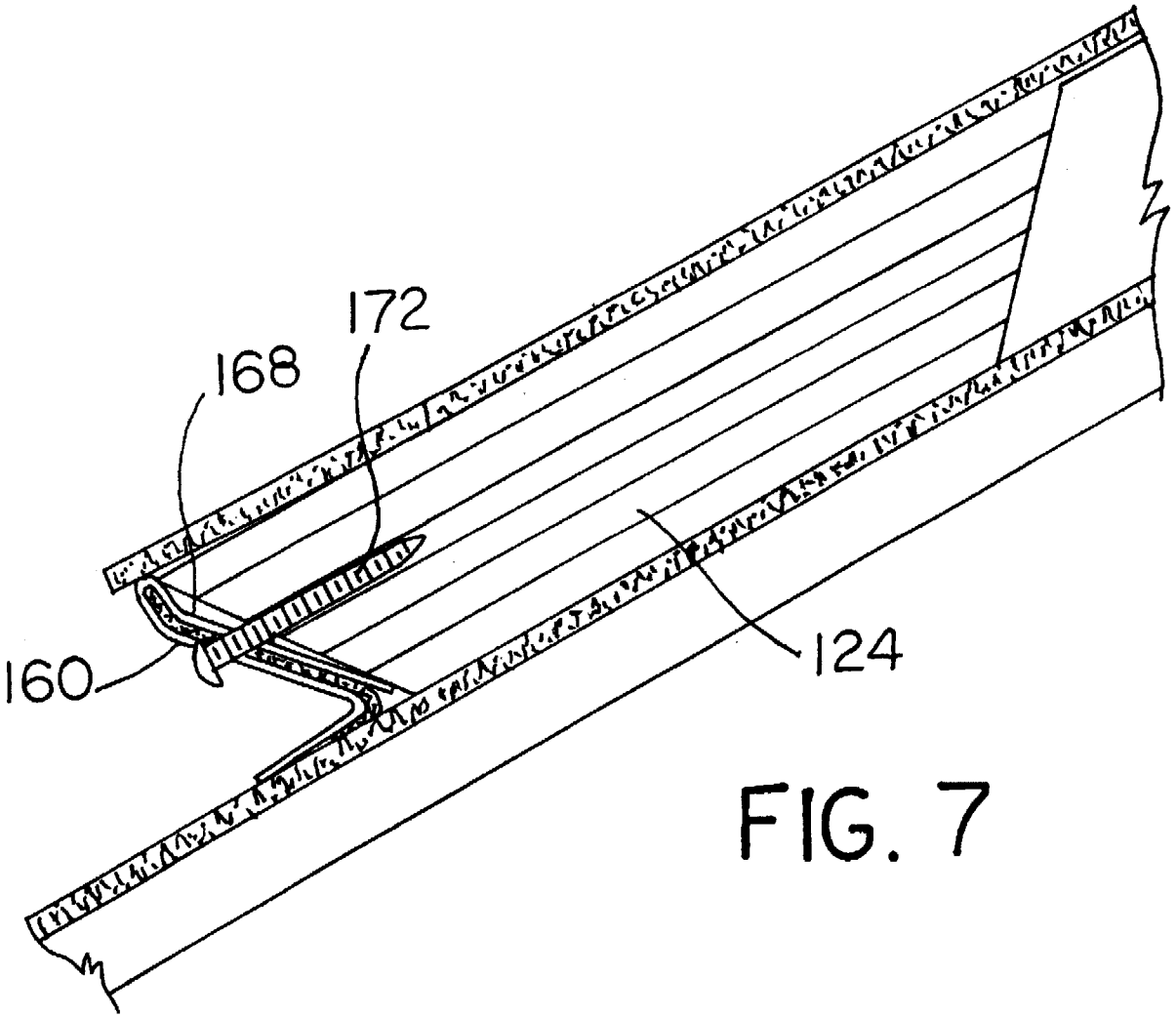

Referring now to the embodiment of FIGS. 2 and 4, elements the same or substantially the same as those of the preferred embodiment retain the same reference character, but increase by 100. Since the fabric itself repels moisture, and thus prevents entry of moisture into the attic or upper story of the structure covered by the roof 112, the flashing 140 need only support the fabric 138. Accordingly, the flashing 140 may be of an extremely open, porous inexpensive material, such as woven wire fabric commonly referred to as "chicken wire."Referring to FIG. 2, side member 158 of flashing 140 is joined to side member 160 thereof at apex 162. Side member 160 includes a turned over portion 164 that cooperates with side member 160 to define a pocket which receives the fabric 138. Side member 158 is nailed directly to the underlayment 118 through shingles 120 by nails 166. Preferably, a portion 154 of the fabric 138 curves under the lower edge of turned over portion 164 and sweeps against the shingles 120 mounted on underlaymeat 118 in a manner similar to that shown in the embodiment of FIGS. 1 and 3, thereby resisting entry of moisture into the vent part 124 around the lower edge of portion 164. In this way, existing ventilating caps 10 which already have been applied to a roof 112 may be retrofitted to prevent moisture ingress into the attic covered by the roof 112 by applying the flashing 140 and fabric 138 by nailing the side member 158 to the roof without disturbing the upper portion 128 of the ventilating cap 110. The embodiment of FIG. 5 is the same as that of FIGS. 2 and 4, except that the turned over portion 168 is turned over in a direction opposite to the turned over portion 164 of the embodiment of FIGS. 2 and 4. Accordingly, a pocket is formed receiving the fabric 138, but a portion of the fabric 138 indicated at 170 is bent around apex 162 to assure that moisture cannot enter around the lower edge of the fabric. Referring to FIG. 6, the fabric 138 is crimped to the side member 162. FIG. 6 is in all other ways identical to FIG. 5. Referring to FIG. 7, instead of being nailed to the roof, the flashing 40 holding fabric 38 is installed by using self-tapping screws 172 which extend through the side member 160, the fabric 138, the turned over portion 168, and into the vent part 124. The embodiment of FIG. 7 is otherwise identical to the embodiment of FIGS. 2 and 4.

I claim:

1. A ventilating cap for a ridge of a roof, said roof having a pair of upwardly tapering sides tapering toward said ridge and a vent opening extending longitudinally along said ridge, said cap including a pair of vent parts, each of said vent parts being located on said roof along opposite sides of said vent opening and having an upper surface extending across said vent opening to interconnect said vent parts and inner and outer side edges extending from said upper surface to said roof, each of said vent parts further defining elongated vent passages extending transversely between said inner and outer side edges to provide a vent path from said vent opening to ambient atmosphere, and a flexible, air permeable, moisture repelling fabric covering said outer side edges and extending over said vent passages to resist penetration of moisture into said vent openings.

2. Ventilating cap as claimed in claim 1, wherein said fabric is supported by a longitudinally extending flashing members extending along each of said outer side edges.

3. Ventilating cap as claimed in claim 2, wherein each of said flashing members are secured to a corresponding vent part.

4. Ventilating cap as claimed in claim 3, wherein one of more fasteners extend through the flashing members, the flexible fabric supported by the flashing members, and into the corresponding outer side edge to thereby secure said flashing members and the fabric supported thereby to said cap.

5. Ventilating cap as claimed in claim 2, wherein each of said flashing members includes a pair of side members forming an angle therebetween, one of said side members extending along the corresponding outer side edge of the cap, the other side member of each flashing member extending along the roof.

6. Ventilating cap as claimed in claim 5, wherein fasteners extend through said other side members to secure said flashing members to the roof, said flashing members being unattached to said vent parts.

7. Ventilating cap as claimed in claim 5, wherein fasteners extend through the one side members, said fabric, and into said vent parts to secure said flashing members to said vent parts.

8. Ventilating cap as claimed in claim 2, wherein said flashing member is perforated.

9. Ventilating cap as claimed in claim 2, wherein said flashing member is made of woven wire fabric.

10. Ventilating cap as claimed in claim 9, wherein each of said flashing members includes a pair of side members forming an angle therebetween, one of said side members extending along the corresponding outer side edge of the cap, the other side member of each flashing member extending along the roof, said fabric including a portion extending between said roof and the other side member.

11. Ventilating cap as claimed in claim 9, wherein said flashing member includes a turned over portion defining a pocket retaining said fabric on said flashing member.

12. Ventilating cap as claimed in claim 2, wherein said flashing member includes a turned over portion defining a pocket retaining said fabric on said flashing member.

13. Ventilating cap as claimed in claim 2, wherein a portion of said fabric extends from said flashing member and engages said roof.

14. Ventilating cap as claimed in claim 2, wherein said fabric is a nonwoven, spunbonded fabric consisting of randomly arranged nonwoven fibers.

* * * * *